United States Patent [19]

Wang

[11] 4,439,212

[45] Mar. 27, 1984

[54] PROCESS AND DEVICE FOR GASEOUS ATMOSPHERE SEPARATION IN PLANTS FOR HEAT TREATMENT UNDER ATOMOSPHERE

[75] Inventor: Robert Wang, Wissous, France

[73] Assignee: Midland-Ross Corporation, Cleveland, Ohio

[21] Appl. No.: 486,113

[22] Filed: Apr. 18, 1983

Related U.S. Application Data

[63] Continuation of Ser. No. 242,752, Mar. 11, 1981, abandoned.

[30] Foreign Application Priority Data

Mar. 14, 1980 [FR] France ..... 80 05763

[51] Int. Cl.[3] ..... B01D 5/00

[52] U.S. Cl. ..... 55/27; 55/72; 55/264; 55/269

[58] Field of Search ..... 55/25, 27, 47, 50, 53, 55/72, 183, 196, 208, 262, 264, 269; 427/432, 433

[56] References Cited

U.S. PATENT DOCUMENTS

| | | | |
|---|---|---|---|
| 3,136,627 | 6/1964 | Caldwell, Jr. et al. | 55/72 |
| 3,436,211 | 4/1969 | Dewing | 55/72 X |
| 3,900,298 | 8/1975 | St. Cyr | 55/72 X |
| 4,152,471 | 5/1979 | Schnedler et al. | 427/432 X |
| 4,296,145 | 10/1981 | Higuchi et al. | 427/432 X |

*Primary Examiner*—John Adee

*Attorney, Agent, or Firm*—H. Duane Switzer

[57] ABSTRACT

A process is described for the separation of gaseous atmospheres in heat treatment plants, under atmosphere, especially in dip metal coating plants; this process being characterized by the fact that the gaseous atmosphere separation is performed near the coating metal bath and the heat treatment furnace by injecting a gas flow into an enclosed space connecting the heat treatment furnace to the metal bath in such a way that a part of this gas flow is conveyed to the furnace and the other part sweeps the bath neighboring zone, collects coating metal vapors, and is then exhausted and treated. Also described is a device for carrying out the above process.

16 Claims, 1 Drawing Figure

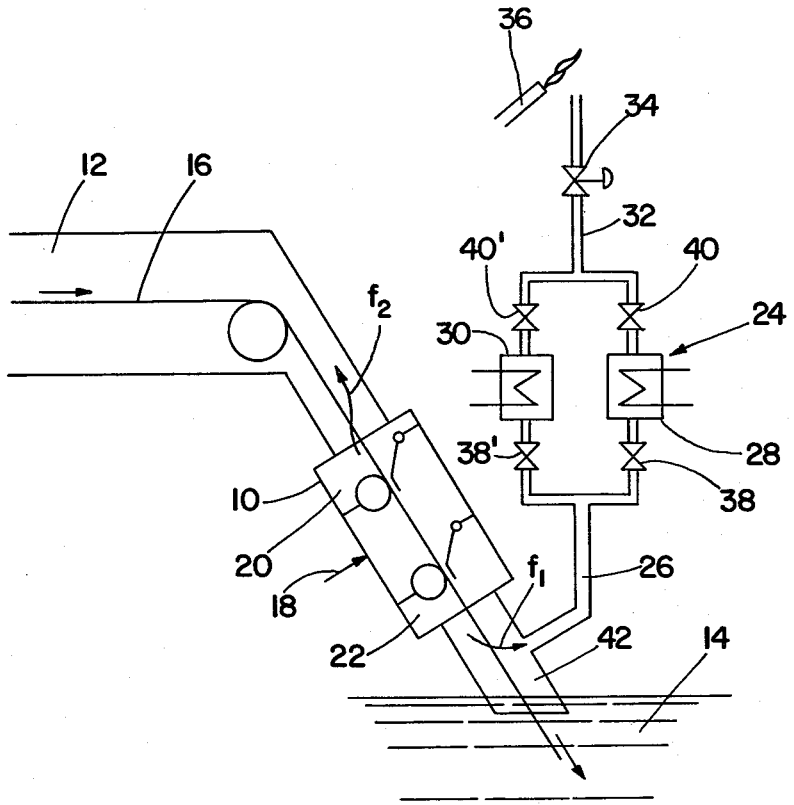
36
34
12
16
32
40'
40
$f_2$
24
30
28
38'
38
10
20
$f_1$
26
18
42
14
22

PROCESS AND DEVICE FOR GASEOUS ATMOSPHERE SEPARATION IN PLANTS FOR HEAT TREATMENT UNDER ATOMOSPHERE

This application is a continuation of application Ser. No. 242,752, filed Mar. 11, 1981, abandoned.

This invention relates to a process and a device for the separation of gaseous atmospheres in heat treatment plants, under atmosphere, especially in dip metal coating plants. It is well known that, in a great number of heat treatment plants, under atmosphere before dip coating, the metal forming the coating is heated to temperatures that are much higher than the melting temperature. This heating results in an intense metal evaporation. The vapors spread into various parts of the treatment plant and condense and form a deposit on the coldest parts. These metal deposits may give rise to difficulties when they appear on systems or pipings conveying protective gas. The metal particles are thus in suspension and may come into contact with the material to be metal coated, for example, a strip thus preventing an efficient metal coating. These difficulties appear especially in strip annealing lines before coating with zinc, zinc-aluminum alloy or any other alloy. The purpose of the invention is to prevent any transfer of vapors containing coating metal to parts of the plant where a heat treatment is performed. For this purpose, the invention concerns a process for the separation of gaseous atmospheres in heat treatment plants under atmosphere, especially in dip metal coating plants. This process is characterized by the fact that the gaseous atmosphere separation is performed near the coating metal bath surface and the heat treatment furnace.

According to this process, a gas flow is injected into an enclosed space connecting the heat treatment furnace to the metal coating bath in such a way that a part of this gas flow is conveyed to the heat treatment furnace and the other part sweeps the bath neighboring zone, collects coating metal vapors, and is then exhausted and treated.

According to another aspect of this process, the part of the gas flow containing metal vapors is discharged and treated so as to achieve a metal vapor condensation and subsequently a recovery of the metal evaporated from the bath, the protective gas contained in the gas flow being burned at the outlet of the treatment envelope.

The invention also concerns a device that will bring the above described process into operation. This device is characterized by the fact that it is provided with: an enclosed space through which the material to be metal coated is conveyed between the heat treatment furnace and the metal bath; means of injecting the gas flow into the aforesaid enclosed space; means of dividing the gas flow into two parts, these means being located in the enclosed space and so designed that the division of the flow into two parts, to the heat treatment furnace and to the metal coating bath, be in accordance with the requirements of the treatment and metal coating process; and means of exhausting and then treating the gases containing coating metal vapors.

According to the invention, the means of dividing the gas flow consist of a system with two vestibules arranged in the enclosed space, the gas flow being injected between these two vestibules, the cross sections of passage of which are so adjusted as to divide the gas flow into two parts.

According to another aspect of this invention, the means of exhausting the gases containing coating metal vapors comprise: an insulated discharge pipe; two or more parallel mounted liquid cooled exchangers which condense the metal vapors; a protective gas exhaust pipe provided with a pressure control valve; and a gas burning system consisting of a torch for instance.

According to another aspect of the invention, the flowrate at the pressure control valve of the burnt gas exhaust pipe is so adjusted and regulated as to maintain a positive pressure above the bath surface.

Other characteristics and advantages of the present invention will now be described with reference to the attached drawing the single FIGURE of which is a schematic view of a device according to the invention located on an annealing plant before dip coating in a metal bath, for example, a liquid zinc batn or zinc aluminum alloy bath or any other alloy. As indicated above, the gaseous atmospheres are separated near the molten metal bath surface 14 and the heat treatment furnace 12. This separation is achieved by the injection 18 of a gas flow into an enclosed space 10 arranged on the travel of the material to be coated (in this example a strip 16) between the furnace 12 and the metal bath 14.

According to the invention, the gas of the gas flow injected 18 is previously heated so as not to cool the strip, this heating being performed in accordance with the requirements of the treatment and metal coating process used.

According to this example of design, the gas flow separation device consists of two vestibules 20,22 between which the gas flow 18 is injected. The cross sections of passage of the two vestibules 20,22 are so adjusted that the gas flow is divided into two distinct streams, one stream (arrow f1) being conveyed to the bath, and the other stream (arrow f2) being conveyed to the heat treatment furnace 12. The separation of the gas flows on each side of the device is performed in such a way that it meets the overall requirements of the treatment and metal coating process.

Each vestibule can be of the flap or roller type, or of the flap and roller type as shown on the drawing. It may include means making a quick opening possible in order to ensure the passage of defective strips or of inlet material. Locking systems can be provided to reduce the gas flow rates when the plant is stopped.

The device, according to the invention, also includes a system, located in the chute 42 above the metal bath, for the exhaustion and the treatment of protective gas containing coating metal vapors. This system referred to under number 24, comprises an insulated discharge pipe 26 which connects the chute 42 with two parallel mounted exchangers 28,30 (water cooled for example) for metal vapor condensation. The exchangers 28,30 are connected with an exhaust pipe 32 that is provided with a pressure control valve 34. This system 24 is completed by a gas burning device, including a torch 36 for example. The exchangers 28,30 are provided with downstream shut-off valves 40,40' and upstream shut-off valves 38,38' which make possible the removal and cleaning of the exchanger tubes on which the coating metal vapors condense. The cleaning of one exchanger occurs while the other exchanger ensures the operation of the equipment. The control valve 34, located on the gas exhaust pipe 32, makes it possible to maintain a positive pressure above the metal bath surface and to prevent any ambient air penetration likely to cause an explosion. The usual operating parameters of a plant according to the invention are given hereunder by way of non-limitative example:

| | |
|---|---|
| Gas flow | |
| Nature: | N2, N2 + H2 mixture in any proportion containing 0 to 75% of hydrogen |
| Temperature: | 20 to 450° C. |
| Pressure: | in the separation device: 0.6 mb to 33 mb |
| Flowrate: | 30 to 200 Nm3/hr through each vestibule 20–22 |
| Metal bath | |
| Nature: | Zinc, Zn + Al alloy in any required proportion |
| Temperature: | 450 to 650° C. |

It is well understood that this invention is not limited to the herein described and illustrated example of design, but includes all the variants thereof. In the same way the application chosen to illustrate the invention is only one simple and non-limitative example.

What is claimed is:

1. A process comprising:

(a) continuously conveying a metal strip through a furnace;

(b) downstream from the furnace, continuously conveying the metal strip through a bath of heated coating metal, coating metal vapor tending to travel upstream adjacent the metal strip from the bath toward the furnace;

(c) between the furnace and bath, injecting a gas flow around the conveyed metal strip, directing a first portion of the gas flow downstream toward the bath, and directing a second portion of the gas upstream toward the furnace;

(d) upstream from the bath, sweeping the coating metal vapor from adjacent the metal strip with the gas flow first portion to an exhaust;

(e) directing the gas flow in the exhaust through at least one of at least two exchangers connected in parallel, each exchanger selectively connected to the exhaust by a shut-off valve; and, (f) recovering the coating metal vapor from the gas flow first portion in the exhaust, by condensing the metal vapor from at least one exchanger.

2. The process as set forth in claim 1 further including the step of treating the gas flow first portion subsequent to the metal vapor recovery.

3. The process as set forth in claim 2 wherein the treating step includes burning the gas flow first portion.

4. The process as set forth in claim 1 further including the step of heating the air flow precedent to the air flow injecting step, whereby the injection step does not cool the strip excessively.

5. The process as set forth in claim 4 wherein the air flow is heated to between 20° and 450° C.

6. The process as set forth in claim 1 wherein the gas flow includes nitrogen.

7. The process as set forth in claim 1 wherein the gas flow consists of a mixture of nitrogen and hydrogen 8. An apparatus comprising:

(a) an enclosure extending between a furnace for heating a metal strip and a coating metal bath disposed downstream from the furnace for coating the metal strip, coating metal vapors escaping from the bath and tending to travel upstream through the enclosure toward the furnace;

(b) conveying means for continuously conveying the metal strip through the furnace, the enclosure, and the coating metal bath;

(c) gas flow injecting means for injecting a gas flow into the enclosure;

(d) flow dividing means for dividing the injected gas flow into at least first and second portions, the gas flow first portion being directed downstream toward the bath to sweep the coating metal vapors downstream therewith and the gas flow second portion being directed upstream toward the furnace;

(e) an exhaust disposed between the gas flow dividing means and the bath for exhausting the gas flow first portion and swept coating metal vapors, whereby the coating metal vapors are swept from the metal strip and the furnace; and (f) metal vapor recovery means operatively connected with the exhaust for recovering the coating metal vapor swept into the exhaust with the gas flow first portion, said metal vapor recovery means comprising at least two exchangers for condensing the metal vapor, each exchanger being provided with a shut-off valve for selectively connecting that exchanger with the exhaust.

9. The apparatus as set forth in claim 8 wherein the gas flow dividing means includes means for defining a first passage of variable width downstream from the gas flow injecting means and through which the metal strip is conveyed, the gas flow first portion flowing throug the first passage, and means for defining a second passage of variable width upstream from the gas flow injecting means and through which the metal strip is conveyed, the gas flow second portion flowing through the second passage.

10. The apparatus as set forth in claim 9 wherein the first and second passage defining means includes at least first and second flaps.

11. The apparatus as set forth in claim 10 wherein the first and second passage defining means includes at least first and second rollers disposed adjacent the first and second flaps, respectively, to define the first and second passages therebetween.

12. The apparatus as set forth in claim 8 wherein the exhaust includes an insulated pipe upstream from the exchangers to inhibit the coating metal vapor from condensing in the exhaust.

13. The apparatus as set forth in claim 8 further including a pressure control valve disposed downstream from the metal vapor recovery means.

14. The apparatus as set forth in claim 13 further including burning means disposed downstream from the pressure control valve for burning gases exhausted therethrough.

15. The apparatus as set forth in claim 14 wherein the burning means includes an open flame.

16. The apparasus as set forth in claim 8, wherein two exchangers for condensing the metal vapor are provided.

* * * * *